US012674215B2

(12) United States Patent
Hoffmann et al.

(10) Patent No.: US 12,674,215 B2
(45) Date of Patent: Jul. 7, 2026

(54) COLD ROLLED AND HEAT-TREATED STEEL SHEET AND METHOD OF MANUFACTURING THEREOF

(71) Applicant: ArcelorMittal, Luxembourg (LU)

(72) Inventors: Etienne Hoffmann, Maizières-lès-Metz (FR); Veronique Hebert, Maizières-lès-Metz (FR)

(73) Assignee: ArcelorMittal, Luxembourg (LU)

( * ) Notice: Subject to any disclaimer, the term of this patent is extended or adjusted under 35 U.S.C. 154(b) by 418 days.

(21) Appl. No.: 18/009,790

(22) PCT Filed: Jun. 12, 2020

(86) PCT No.: PCT/IB2020/055526

§ 371 (c)(1),
(2) Date: Dec. 12, 2022

(87) PCT Pub. No.: WO2021/250450

PCT Pub. Date: Dec. 16, 2021

(65) Prior Publication Data

US 2023/0243007 A1 Aug. 3, 2023

(51) Int. Cl.
*C21D 8/02* (2006.01)
*C21D 8/0221* (2026.01)
(Continued)

(52) U.S. Cl.
CPC ..... *C21D 8/0236* (2013.01); *C21D 8/0226* (2013.01); *C21D 8/0263* (2013.01);
(Continued)

(58) Field of Classification Search
None
See application file for complete search history.

(56) References Cited

U.S. PATENT DOCUMENTS

2015/0086808 A1 3/2015 Kasuya et al.
2016/0060723 A1 3/2016 Yamazaki et al.
(Continued)

FOREIGN PATENT DOCUMENTS

CN 105018875 A 11/2015
CN 110073026 A 7/2019
(Continued)

OTHER PUBLICATIONS

Search Report of PCT/IB2020/055526 filed Oct. 2, 2021 and International Report on Patentability.
(Continued)

*Primary Examiner* — Anthony M Liang
(74) *Attorney, Agent, or Firm* — Davidson Kappel LLC

(57) ABSTRACT

A cold rolled and heat-treated steel sheet, the steel including, in weight percentage, 0.17%≤carbon≤0.25%, 2%≤manganese≤3%, 0.9%≤silicon≤2%, 0%≤aluminum≤0.09%, 0.01%≤molybdenum≤0.2%, 0%≤phosphorus≤0.02%, 0%≤sulfur≤0.03%, 0%≤nitrogen≤0.09%, and optionally one or more of the following elements 0%≤chromium≤0.3%, 0%≤niobium≤0.06%, 0%≤titanium≤0.06%, 0%≤vanadium≤0.1%, 0%≤calcium≤0.005%, 0%≤boron≤0.010%, 0%≤Magnesium≤0.05%, 0%≤Zirconium≤0.05%, 0%≤Cerium≤0.1%, and the balance including iron and unavoidable impurities, the steel sheet having a microstructure of—50% to 80% of Bainite, 10% to 30% of residual austenite, 15% to 50% of Partitioned martensite, 0% to 10% of ferrite and 0% to 5% fresh martensite in area fractions, and a ferrite-enriched layer extending up to 50 microns from both surfaces of the steel sheet, such ferrite-enriched layer having a mean ferrite content from 55% to 80% in area fraction.

19 Claims, 1 Drawing Sheet

(51) Int. Cl.

| | |
|---|---|
| ***C21D 8/0247*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C23C 2/06*** | (2006.01) |
| ***C23C 2/40*** | (2006.01) |

(52) U.S. Cl.

CPC ..... *C21D 8/0273* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C23C 2/06* (2013.01); *C23C 2/40* (2013.01); *C21D 2211/001* (2013.01); *C21D 2211/002* (2013.01); *C21D 2211/005* (2013.01); *C21D 2211/008* (2013.01)

(56) References Cited

U.S. PATENT DOCUMENTS

| | | | | |
|---|---|---|---|---|
| 2018/0105908 | A1* | 4/2018 | Hayashi ..... | C22C 38/42 |
| 2018/0237877 | A1 | 8/2018 | Wang et al. | |
| 2018/0371566 | A1 | 12/2018 | Gospodinova et al. | |
| 2019/0040483 | A1 | 2/2019 | Kimata et al. | |
| 2019/0040487 | A1 | 2/2019 | Enloe et al. | |
| 2020/0190612 | A1 | 6/2020 | Kwak et al. | |

FOREIGN PATENT DOCUMENTS

| | | | |
|---|---|---|---|
| CN | 110983192 | A | 4/2020 |
| EP | 3287539 | | 2/2018 |
| EP | 3392363 | | 10/2018 |
| EP | 3421625 | | 1/2019 |
| JP | 2012021225 | | 2/2012 |
| KR | 20180099876 | A | 9/2018 |
| WO | WO2014171057 | A1 | 10/2014 |
| WO | WO2016001710 | | 1/2016 |
| WO | WO2016001898 | A2 | 1/2016 |

OTHER PUBLICATIONS

De Moor E et al, "Quench and Partitioning response of a Mo-alloyed CMnSi steel", New Developments on Metallurgy and Applications of High Strength Steels : Buenos Aires 2008 ; International Conference, May 26-28, Hilton Hotel, Buenos Aires, Argentina, Minerals, Metals & Materials Society, Warrendale, PA., USA, (May 26, 2008), vol. 2, ISBN 978-0-87339-729-2, pp. 721-730.

Cooman De B C et al, "Quench and Partitioning Steel: A New AHSS Concept for Automotive Anti-Intrusion Applications", Steel Research International, Verlag Stahleisen GmbH., Dusseldorf, DE, (Sep. 1, 2006), vol. 77, No. 9/10, ISSN 1611-3683, pp. 634-640.

Techniques De L'ingenieur, Mesures et Analyse; Fra; Paris: Tech.-ING.; DA. 1981; vol. 20; No. 59; p. 1280 by M.Murat, see description in specification of present application.

Bohemen et al (2012): "Banite and martensite start temperature calculated with exponential carbon dependence," Materials Science and Technology, (20120000), vol. 28, No. 4, pp. 487-495.

* cited by examiner

COLD ROLLED AND HEAT-TREATED STEEL SHEET AND METHOD OF MANUFACTURING THEREOF

The present invention relates to cold rolled and heat-treated steel sheet which is suitable for use as a steel sheet for vehicles.

BACKGROUND

Automotive parts are required to satisfy two inconsistent necessities, namely ease of forming and strength. However in recent years a third requirement of improvement in fuel consumption is also bestowed upon automobiles in view of global environment concerns. Thus, now automotive parts must be made of material having high formability in order to fit in the criteria of ease of fit in the intricate automobile assembly and at the same time to have improved strength for vehicle crashworthiness and durability while reducing the weight of the vehicle to improve fuel efficiency. Further, the steel part must be weldable while not suffering from liquid metal embrittlement.

SUMMARY OF THE INVENTION

Therefore, intense Research and development endeavors have been undertaken to reduce the amount of material utilized in car by increasing the strength of material. Conversely, an increase in strength of steel sheets decreases formability, and thus development of materials having both high strength and high formability is necessitated.

Earlier research and developments in the field of high strength and high formability steel sheets have resulted in several methods for producing high strength and high formability steel sheets, some of which are enumerated herein for appreciation of the present invention:

The patent EP3287539 describes a multi-layer product with a surface enriched in ferrite to improve bendability hut unable to reach high hole expansion, presence of interface between ferrite and hard phases such as martensite or austenite. Further the steel of EP3287539 is does not have sufficient LME resistance especially for cold rolled coated steel sheet.

The patent US2019/0040487 describes a steel sheet which is LME resistant but does not describe the mechanical properties such as tensile strength, total elongation that can be achieved.

The known prior art related to the manufacture of high strength and high formability steel sheets is inflicted by one or the other lacuna: hence there lies a need for a cold rolled steel sheet having strength greater than 1100 MPa and a method of manufacturing the same.

It is an object of the present invention to provide cold-roped and heat-treated steel sheets that simultaneously have:

- an ultimate tensile strength greater than or equal to 1170 MPa and preferably above 1180 MPa, or even above 1200 MPa,
- a hole expansion ratio greater than or above 30% and preferably above 35%
- an adequate liquid metal embrittlement resistance.

In a preferred embodiment, the cold rolled and heat-treated steel sheet shows a yield strength value greater than or above 780 MPa and preferably above 800 MPa.

In another preferred embodiment, the cold-rolled and heat-treated steel sheet shows a total elongation value greater than or above 12.0%

Preferably, such steel can also have a good suitability for forming, in particular for rolling with good weldability and coat ability.

Another object of the present invention is also to make available a method for the manufacturing of these sheets that is compatible with conventional industrial applications while being robust towards manufacturing parameters shifts.

The cold rolled heat treated steel sheet of the present invention is coated with zinc or zinc alloys, or with aluminum or aluminum alloys to improve its corrosion resistance.

Other characteristics and advantages of the invention will become apparent from the following detailed description of the invention.

Carbon is present in the steel from 0.17% to 0.25%. Carbon is an element necessary for increasing the strength of a steel sheet by delaying the formation of ferrite and bainite during cooling after annealing. Further carbon also plays a pivotal role in austenite stabilization. A content less than 0.17% would not allow stabilizing austenite, thereby decreasing strength as well as ductility. On the other hand, at a carbon content exceeding 0.25%, a weld zone and a heat-affected zone are significantly hardened, and thus the mechanical properties of the weld zone are impaired. Preferable limit for carbon is from 0.18% to 0.23% and more preferred limit is from 0.18% to 0.21%.

Manganese content of the steel of the present invention is from 2% to 3%. Manganese is an element that imparts strength as well as stabilizes austenite to obtain residual austenite. An amount of at least 2% of manganese is necessary to provide the strength and hardenability of the steel sheet by delaying the formation of Ferrite as well as to stabilize austenite. Thus, a higher percentage of Manganese such as 2.2 to 2.9% is preferred and more preferably from 2.5% to 2.8%. But when manganese is more than 3%, this produces adverse effects such as slowing down the transformation of austenite to bainite during the isothermal holding for bainite transformation, leading to a reduction of ductility. Additionally, when the manganese is above 3% not enough bainite is formed and the formation of martensite is beyond the targeted limit thus elongation decreases. Moreover, a manganese content above 3% would also reduce the weldability of the present steel.

Silicon content of the steel of the present invention is from 0.9% to 2%. Silicon as a constituent retards the precipitation of carbon as carbides in bainite during the soaking after cooling from high temperature. Thus, during formation of carbide free bainite, austenite is enriched in carbon. Therefore, due to the presence of 0.9% of silicon, Austenite is stabilized at room temperature. Additionally, silicon retards carbides precipitation in martensite. In both cases, carbides in bainite or carbides in martensite are also responsible of elongation decrease. Preventing carbides by the presence of Si is so important However, adding more than 2% of silicon does not improve the mentioned effect and leads to problems such as hot rolling embrittlement as well as Silicon more than 2% in the steel of the present invention makes Zn not soluble in the grains. So, when welding, liquid Zn goes along the grain boundaries, instead of going into the grains causing liquid metal embrittlement. Therefore, the concentration is controlled within an upper limit of 2%. Preferred limit for silicon for the present steel is from 1% to 1.9% and more preferably from 1.1% to 1.8%.

The content of aluminum of the steel of the present invention is from 0 to 0.09%. Aluminum is added during the steel making for deoxidizing the steel to trap oxygen. Higher than 0.09% will increase the Ac3 point, thereby lowering the productivity. Additionally, within such range, aluminum bounds nitrogen in the steel to form aluminum nitride so as to reduce the size of the grains. But, whenever the content of aluminum exceeds 0.09% in the present invention, the amount and size of aluminum nitrides are detrimental to hole expansion and bending. Preferable limit for aluminum is 0% to 0.06% and more preferably 0% to 0.05%.

Molybdenum is an essential element that is present from 0.01% to 0.2% in the steel of the present invention; Molybdenum plays an effective role in improving hardenability and hardness, delays the formation of ferrite and bainite during the cooling after annealing, when added in an amount of at least 0.01%. Mo is also beneficial for the toughness of the hot rolled product resulting to an easier manufacturing. However, the addition of Molybdenum excessively increases the cost of the addition of alloy elements, so that for economic reasons its content is limited to 0.2%. Molybdenum also facilitates the formation of Ferrite microstructure on the surface up to the thickness depth of 50 microns measured from the outer surface because Ac3 is increased a little, for the same soaking and dew point temperatures thereby increasing the formation of Ferrite on the surface steel of the present invention. The preferable limit for Molybdenum is from 0.05% to 0.15% and more preferably from 0.06% to 0.12%.

Phosphorus content of the steel of the present invention is limited to 0.02%. Phosphorus is an element which hardens in solid solution. Therefore, a small amount of phosphorus, of at least 0.002% can be advantageous, but phosphorus has its adverse effects also, such as a reduction of the spot weldability and the hot ductility, particularly due to its tendency to segregation at the grain boundaries or co-segregation with manganese. For these reasons, its content is preferably limited to a maximum of 0.015%.

Sulfur is not an essential element but may be contained as an impurity in steel. The sulfur content is preferably as low as possible but is 0.03% or less and preferably at most 0.005%, from the viewpoint of manufacturing cost. Further if higher sulfur is present in steel it combines to form sulfide especially with Mn and Ti which are detrimental for bending, hole expansion and elongation of the steel of the present invention.

Nitrogen is limited to 0.09% to avoid ageing of material and to minimize the precipitation of nitrides during solidification which are detrimental for mechanical properties of the Steel.

Chromium is an optional element of the steel of the present invention, and is from 0% to 0.3%. Chromium provides strength and hardening to the steel, but when used above 0.3% impairs surface finish of the steel. The preferred limit for chromium is from 0.01% to 0.25% and more preferably from 0.01% to 0.1%.

Niobium is an optional element that can be added to the steel from 0% to 0.06%, preferably from 0.0010 to 0.03%. It is suitable for forming carbonitrides to impart strength to the steel according to the invention by precipitation hardening. Because niobium delays the recrystallization during the heating, the microstructure formed at the end of the holding temperature and as a consequence after the complete annealing is finer, this leads to the hardening of the product. But when the niobium content is above 0.06% the amount of carbo-nitrides is not favorable for the present invention as large amount of carbo-nitrides tend to reduce the ductility of the steel.

Titanium is an optional element which may be added to the steel of the present invention from 0% to 0.06%, preferably from 0.001% to 0.03%. As niobium, it is involved in carbo-nitrides so plays a role in hardening. But it is also involved to form TiN appearing during solidification of the cast product. The amount of Ti is so limited to 0.06% to avoid coarse TiN detrimental for hole expansion. In case the titanium content is below 0.001% it does not impart any effect on the steel of the present invention.

Vanadium is an optional element which may be added to the steel of the present invention from 0% to 0.1%, preferably from 0.001% to 0.1%. As niobium, it is involved in carbo-nitrides so plays a role in hardening. But it is also involved to form VN appearing during solidification of the cast product. The amount of V is so limited to 0.1% to avoid coarse VN detrimental for hole expansion. In case the vanadium content is below 0.001% it does not impart any effect on the steel of the present invention.

Calcium is an optional element which may be added to the steel of the present invention from 0% to 0.005%, preferably from 0.001% to 0.005%. Calcium is added to the steel of the present invention as an optional element especially during the inclusion treatment. Calcium contributes towards the refining of the steel by arresting the detrimental sulphur content in globularizing it.

Boron is an optional element, which can be added from 0 to 0.010% preferably from 0.001% to 0.004%, to harden the steel Other elements such as cerium, magnesium or zirconium can be added individually or in combination in the following proportions: Ce≤0.1%, Mg≤0.05% and Zr≤0.05%. Up to the maximum content levels indicated, these elements make it possible to refine the inclusion grain during solidification.

The remainder of the composition of the steel consists of iron and inevitable impurities resulting from processing.

The microstructure of the steel sheet according to the invention comprises 50% to 80% Bainite, 15% to 50% of Partitioned martensite, 10% to 30% of Residual Austenite, 0% to 10% of Ferrite, 0% to 5% of Fresh martensite by area fraction.

The surface fractions of phases in the microstructure are determined through the following method: a specimen is cut from the steel sheet, polished and etched with a reagent known per se, to reveal the microstructure. The section is afterwards examined through scanning electron microscope, for example with a Scanning Electron Microscope with a Field Emission Gun ("FEG-SEM") at a magnification greater than 5000×, in secondary electron mode.

The determination of the surface fraction of ferrite is performed thanks to SEM observations after Nital or Picral/Nital reagent etching.

The determination of the volume fraction of retained austenite is performed thanks to X-ray diffraction and the percentages of blocky austenite and of film-like austenite are determined by image analysis.

Bainite is the matrix of the steel and is present from 50% to 80%, In the frame of the present invention, bainite can comprise carbide-free bainite and/or lath bainite. When present, lath bainite is in form of laths of thickness from 1 micron to 5 microns. When present, carbide-free bainite is a bainite having a very low density of carbides, below 100 carbides per area unit of 100 $\mu m^2$ and possibly containing austenitic islands. Bainite provides an improved elongation as well as the hole expansion to the steel of the present invention when controlled in the invention range. The preferred presence for bainite is from 55% to 75% and more preferably from 55% to 70%.

Residual Austenite is contained in an amount of 10% to 30% and imparts ductility to the present steel. In the frame of the present invention, Residual Austenite can comprise film-like austenite and/or blocky austenite. Film-like Austenite of the present invention can be present between bainite and partitioned martensite and shows an aspect ratio above 3. Blocky Austenite can be present in form of islands in bainite showing an aspect ratio below 2 and can act as an effective carbon trap thereby assisting in formation of carbide-free bainites Blocky austenite is less than 5 microns in the biggest dimension of the grains and preferably less than 3 microns and can form during the overaging holding.

The retained austenite of the present invention preferably contains carbon from 0.9 to 1.15%, with an average content of carbon in austenite of 1.00% It is preferred to have residual austenite from 12% to 25% and more preferably from 12% to 20%. It is preferred to have 4% or more of Film-like austenite and 4% or more of blocky austenite.

Partitioned martensite is contained in an amount of 15% to 50%. to achieve the strength level of 1170 MPa or more. If the martensite amount reaches beyond 50%, it would have detrimental impact on ductility. Partitioned martensite of the present steel can be in the form of laths wherein the lath thickness is more than 0.1 micron. Martensite, that is formed during the cooling after annealing, is transformed into Partitioned martensite during the heating to the overaging temperature. The preferred presence of the partitioned martensite for the steel of the present invention is from 15% to 45% and more preferably from 20% to 40%.

Fresh Martensite and Ferrite can be present in the steel according to the invention, as isolated phases. Ferrite may be present from 0% to 10% in the steel, except at the surface layer which is rich in ferrite. Such ferrite may comprise polygonal ferrite, lath ferrite, acicular ferrite, plate ferrite or epitaxial ferrite. The presence of ferrite in the present invention may impart the steel with formability and elongation. Presence of ferrite has also negative impacts due to the fact that ferrite increases the gap in hardness with hard phases such as martensite and bainite and reduces local ductility. If ferrite presence is above 10% the targeted tensile strength is not achieved as well as hole expansion rate can decrease due to the increase of the amount of interfaces between ferrite and hard phases. Hence the preferred presence is from 0% to 5% and more preferably from 0% to 2%. Fresh martensite may also be present from 0% to 5% and preferably from 0% to 2%.

In addition to this microstructure in the core of the steel sheet, it also includes a ferrite-enriched layer extending from both surfaces of the steel sheet up to a depth of 50 microns and showing a ferrite percentage from 55% to 80% in area fraction, preferably from 60% to 78% more preferably from 65% to 75%. The ferrite enriched layer formed on the surface preferably comprises any or all possible ferrite kinds and notably polygonal ferrite, lath ferrite, acicular ferrite, plate ferrite or epitaxial ferrite. This ferrite layer imparts the steel sheet of the invention with resistance against the liquid metal embrittlement (LME).

The remaining part of this surface layer comprises bainite and/or residual austenite and/or martensite.

DETAILED DESCRIPTION

Figure 1:
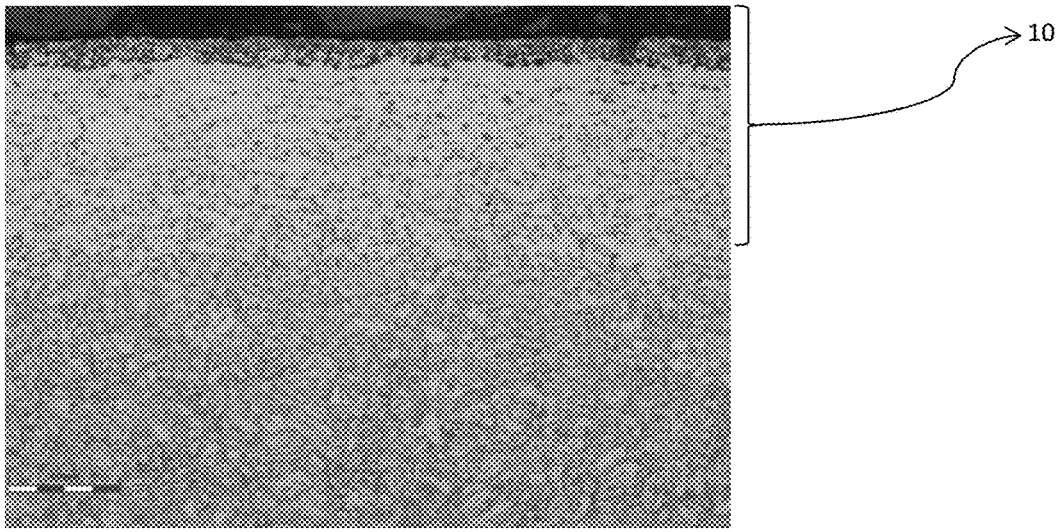
FIG. 1 is a schematic demonstration of the cold rolled steel sheet which is in accordance of the present invention and corresponds to trial I1, the cold rolled steel sheet having a layer enriched in ferrite, wherein the mean ferrite percentage in the layer extending up to 50 microns from the surface is 70%. Ferrite layer designated as 10 shows the ferrite layer having ferrite presence as 70%.
Figure 2:
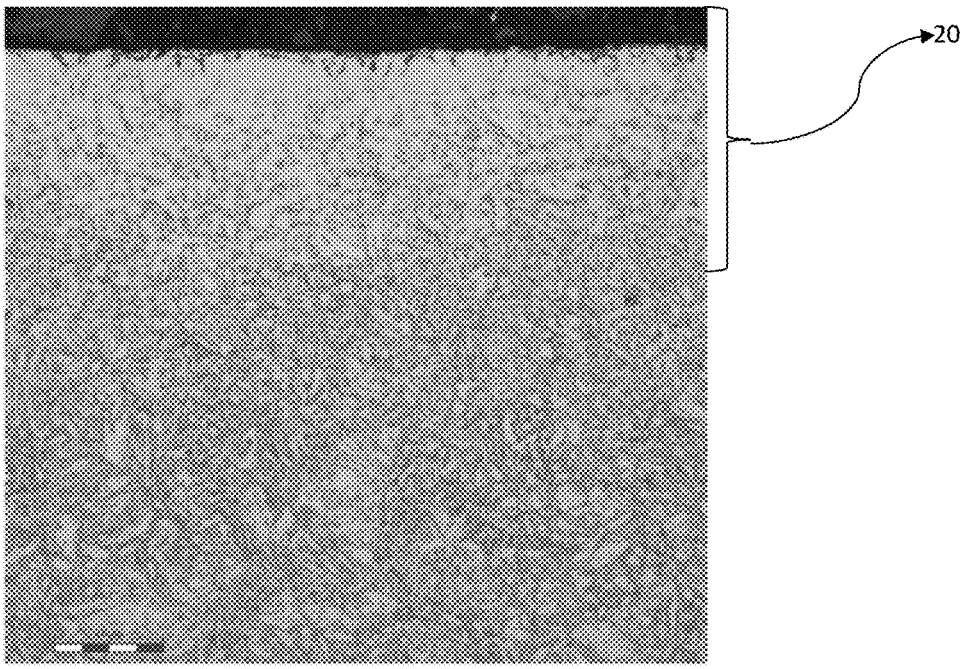
FIG. 2 is a schematic demonstration of the cold rolled steel sheet which is not in accordance of the present invention, the cold rolled steel sheet having a layer enriched in ferrite, wherein the mean ferrite percentage in the layer extending up to 50 microns from the surface is 43%. Ferrite layer designated as 20 shows the ferrite layer having ferrite presence as 43%.

A steel sheet according to the invention can be produced by any suitable method. A preferred method consists in providing a semi-finished casting of steel with a chemical composition according to the invention. The casting can be done either into ingots or continuously in form of thin slabs or thin strips, i.e. with a thickness ranging from approximately 220 mm for slabs up to several tens of millimeters for thin strip.

For example, a slab will be considered as a semi-finished product. A slab having the above-described chemical composition is manufactured by continuous casting wherein the slab preferably underwent a direct soft reduction during casting to ensure the elimination of central segregation and porosity reduction. The slab provided by continuous casting process can be used directly at a high temperature after the continuous casting or may be first cooled to room temperature and then reheated for hot rolling.

The temperature of the slab which is subjected to hot rolling is preferably at least 1000° C., preferably above 1200° C. and must be below 1280° C., in case the temperature of the slab is lower than 1000° C., excessive load is imposed on a rolling mill, and further, the temperature of the steel may decrease to a ferrite transformation temperature during finishing rolling, whereby the steel will be rolled in a state in which transformed ferrite contained in the structure. Further, the temperature must not be above 1280° C. because industrially expensive.

The temperature of the slab is preferably sufficiently high so that hot rolling can be completed entirely in the austenitic range, the finishing hot rolling temperature remaining above 850° C. and preferably above 900° C. It is necessary that the final rolling be performed above 850° C., because below this temperature the steel sheet exhibits a significant drop in rollability. A final rolling temperature from 900 to 950° C. is preferred to have a structure that is favorable to recrystallization and rolling.

The sheet obtained in this manner is then cooled at a cooling rate above 30° C./s to a temperature which is below 550° C. The cooling temperature is kept below 550° C. to avoid oxidation of alloying elements such as manganese, silicon and chromium. Preferably, the cooling rate will be less than or equal to 65° C./s and above 35° C./s. Thereafter the hot rolled steel sheet is coiled and the temperature of the coiled hot rolled steel sheet must be kept below 500° C. to avoid oxidation of Silicon, Manganese, Aluminum and Chromium on the surface of hot rolled coil as these oxides forms cracks on the surface of the hot rolled steel sheet. Thereafter the coiled hot rolled steel sheet is allowed to cool down to room temperature. Then the hot rolled sheet is subjected to on optional scale removal process such as pickling to remove scale formed during hot rolling and ensure that there is no scale on the surface of hot rolled steel sheet before subjecting it to an optional hot band annealing.

The hot rolled sheet may be subjected to an optional hot band annealing at a temperature from 350° C. to 750° C. during 1 to 96 hours. The temperature and time of such hot band annealing is selected to ensure softening of the hot rolled sheet to facilitate the cold rolling of the hot rolled steel sheet.

The Hot rolled steel sheet is then cooled down to room temperature, thereafter, the hot rolled sheet is then cold rolled with a thickness reduction from 35 to 70% to obtain a cold rolled steel sheet.

The cold rolled steel sheet is then subjected to annealing to impart the steel of the present invention with targeted microstructure and mechanical properties.

In the annealing, the cold rolled steel sheet is subjected to two steps of heating to reach the soaking temperature TA from Ac3−10° C. to Ac3+100° C., during the two step heating the dewpoint is maintained from −15° C. to +15° C. to provide the steel of the present invention with a ferrite rich layer on surface to have adequate Liquid metal embrittlement resistance, the preferred dew point is maintained from −10° C. to +10° C. and more preferably from −10° C. to +5° C. The Ac3 for the present steel is determined by a dilatometry test as per the method described in article published in journal "TECHNIQUES DE L'INGENIEUR, MESURES ET ANALYSE; FRA; PARIS: TECH.-ING.; DA. 1981; VOL. 20; NO 59; P1280" by M. Murat.

In step one cold rolled steel sheet is heated from room temperature to temperature HT1 which is in a range from 600° C. to 800° C. at a heating rate HR1 from 2° C./s to 70° C./s. It is preferred to have HR1 rate from 5° C./s to 60° C./s and more preferably from 10° C./s to 50° C./s. The preferred HT1 temperature is from 625° C. to 775° C., more preferably from 640° C. to 750° C.

Thereafter in subsequent second step of heating, the cold rolled steel sheet is heated from temperature HT1 to the soaking temperature TA which is in temperature range from Ac3−10° C. to Ac3+100° C. at a heating rate HR2 from 0.1° C./s to 10° C./s. It is preferred to have HR2 rate from 0.1° C./s to 8° C./s and more preferably from 0.1° C./s to 5° C./s.

The preferred TA temperature is from Ac3 to Ac3+75° C., more preferably from Ac3 to Ac3+50° C. Dew point is maintained from −10° C. to +10° C. at the soaking temperature and preferably from −5° C. to +5° C. to provide the present steel with the ferrite-enriched layer at the surface with the targeted depth.

As mentioned above, the ferrite-enriched layer according to the invention is formed during annealing. Carbon reacts with oxygen to form carbon monoxide that escapes from the steel, resulting in a decarburization of the surface layer, such layer having a microstructure enriched in ferrite and extending from the surface of the sheet up to the depth of 50 microns. This ferrite-enriched layer forms during the heating before annealing and during soaking thanks to the control of dew point. The dew point is controlled from −15° C. to +15° C. during the heating before annealing and from −10° C. to +10° C. during the soaking by using conventional means known by the man skilled in the art, like water injection for example.

Then the cold rolled steel sheet is held at the annealing soaking temperature TA during 10 to 1000 seconds to ensure adequate transformation to Austenite microstructure of the strongly work-hardened initial structure. It is Then the cold rolled steel sheet is cooled in a single step cooling, at a cooling rate CR1 which is more than 30° C./s and preferably more than 40° C./s and more preferably more than 50° C./s to a cooling stop temperature range CS1 from Ms−5° C. to Ms−100° C. and preferably from Ms−5° C. to Ms−75° C. and more preferably from Ms−10° C. to Ms−50° C. During this step of cooling, martensite of the present invention is formed.

In a subsequent step the cold rolled steel sheet is heated to an overaging temperature range TOA from 250° C. to 580° C. from CS1 temperature at a heating rate HR3 from 1° C./s to 100° C./s. During this step, martensite formed during cooling after annealing is transformed into partitioned martensite, thereby assisting in formation of bainite during the holding at TOA temperature. Then the cold rolled steel sheet is held at TOA temperature for over-aging during 5 to 500 seconds allowing the bainite of the present invention to be formed.

Then the cold rolled steel sheet can be brought to the temperature of a hot dip coating bath, which can be from 420° C. to 680° C., depending on the nature of the coating. The coating can be made with zinc or a zinc-based alloy or with aluminium or with an aluminum-based alloy.

Alternatively, the cold rolled steel sheet may also be coated by any of the known industrial processes such as Electro-galvanization, JVD, PVD, Hot dip (GI), GA or ZM etc., which do not require the steel sheet to be brought to the above described range of temperature after averaging. In that case, the steel sheet can be cooled down to room temperature before being coated in a subsequent step.

An optional post batch annealing, preferably done at 170 to 210° C. during 12 h to 30 h can be performed after annealing on a coated product in order to ensure degassing for coated products.

EXAMPLES

The following tests and examples presented herein are non-restricting in nature and must be considered for purposes of illustration only and will display the advantageous features of the present invention and expound the significance of the parameters chosen by inventors after extensive experiments and further establish the properties that can be achieved by the steel according to the invention.

Samples of the steel sheets according to the invention and to some comparative grades were prepared with the compositions gathered in table 1 and the processing parameters gathered in table 2. The corresponding microstructures of those steel sheets were gathered in table 3 and the properties in table 4.

Table 1 depicts the steels with the compositions expressed in percentages by weight.

TABLE 1

| | composition of the trials | | | | | | | | | | | | |
|---|---|---|---|---|---|---|---|---|---|---|---|---|---|
| Trials | C | Mn | Si | Al | Mo | P | S | N | Cr | Nb | Ti | B | Ac3 |
| 1 | 0.199 | 2.620 | 1.270 | 0.030 | 0.097 | 0.0150 | 0.002 | 0.0050 | 0.017 | 0.002 | 0.002 | 0.0004 | 850 |
| 2 | 0.197 | 2.630 | 1.780 | 0.024 | 0.093 | 0.0120 | 0.001 | 0.0037 | 0.015 | 0.002 | 0.002 | 0.0004 | 880 |
| 3 | 0.198 | 2.720 | 1.740 | 0.025 | 0.096 | 0.0120 | 0.001 | 0.0041 | 0.023 | 0.002 | 0.002 | 0.0004 | 875 |
| 4 | 0.196 | 2.710 | 1.780 | 0.024 | 0.095 | 0.0110 | 0.001 | 0.0043 | 0.015 | 0.021 | 0.002 | 0.0004 | 875 |
| 5 | 0.190 | 2.720 | 1.770 | 0.024 | 0.096 | 0.0110 | 0.001 | 0.0044 | 0.015 | 0.022 | 0.022 | 0.0022 | 880 |
| 6 | 0.193 | 2.750 | 1.780 | 0.024 | 0.002 | 0.0110 | 0.001 | 0.0038 | 0.017 | 0.001 | 0.002 | 0.0004 | 870 |
| 7 | 0.188 | 2.750 | 1.680 | 0.021 | 0.002 | 0.0120 | 0.001 | 0.0050 | 0.019 | 0.020 | 0.024 | 0.0026 | 870 |

underlined values: not according to the invention

Table 2 gathers the annealing process parameters implemented on steels of Table 1.

Table 1 also shows Bainite transformation Bs and Martensite transformation Ms temperatures of inventive steel and reference steel. The calculation of Bs is done by using Van Bohemen formula published in Materials Science and Technology (2012) vol 28, no. 4, pp 487-495, which is as follows:

$$Bs=839-(86*[Mn]+23*[Si]+67*[Cr]+33*[Ni]+75*[Mo])-270*(1-EXP(-1.33*[C]))$$

Ms was determined through dilatometry tests in a similar way as Ac3.

Further, before performing the annealing treatment on the steels of invention as well as reference, the samples were heated to a temperature from 1000° C. to 1280° C. and then subjected to hot rolling with finishing temperature above 850° C. The cooling rate after hot rolling was above 30° C./s until cooling down below 550° C. The HT1 temperature is 650° C. for all trials and the HR2 heating rate is at 0.5° C./s for all trials. All cold rolled steel sheets were coated in a zinc bath at temperature 460° C. after the over aging holding.

TABLE 2 process parameters of the trials

| | | Coiling | | HBA | | | |
|---|---|---|---|---|---|---|---|
| Trials | steel sample | Temp (° C.) | Pickling | (° C.) | t (h) | Pickling | CR reduction (%) |
| I1 | 1 | 450 | Y | 550 | 10 | Y | 53 |
| I2 | 2 | 450 | Y | 580 | 10 | Y | 53 |
| I3 | 3 | 450 | Y | 580 | 10 | Y | 50 |
| I4 | 4 | 450 | Y | 620 | 10 | Y | 52 |
| I5 | 5 | 450 | Y | 620 | 10 | Y | 38 |
| R1 | 6 | 450 | Y | 580 | 10 | Y | 52 |
| R2 | 7 | 450 | Y | 550 | 10 | Y | 43 |
| R3 | 3 | 450 | Y | 580 | 10 | Y | 50 |
| R4 | 3 | 450 | Y | 580 | 10 | Y | 50 |

| | Annealing | | | | | | | | Holding | | | |
|---|---|---|---|---|---|---|---|---|---|---|---|---|
| Trials | HR1 (° C./s) | TA (° C.) | Soaking time (s) | Dew point during heating (° C.) | Dew point during soaking (° C.) | CR1 (° C./s) | CS1 (° C.) | HR3 (° C./s) | TOA (° C.) | Time (s) | Bs | Ms |
| I1 | 10 | 880 | 290 | 0 | 2 | 100 | 301 | 45 | 460 | 110 | 513 | 335 |
| I2 | 20 | 890 | 335 | 3 | 2 | 90 | 300 | 45 | 460 | 130 | 502 | 325 |
| I3 | 15 | 890 | 335 | −5 | −2 | 90 | 300 | 45 | 460 | 130 | 494 | 325 |
| I4 | 25 | 890 | 335 | 2 | −1 | 90 | 279 | 51 | 460 | 130 | 495 | 320 |
| I5 | 10 | 890 | 600 | −5 | −5 | 50 | 279 | 51 | 460 | 225 | 496 | 320 |
| R1 | 21 | 870 | 260 | −10 | 0 | 100 | 309 | 42 | 460 | 100 | 499 | 325 |
| R2 | 13 | 870 | 260 | −2 | 0 | 100 | 320 | 40 | 460 | 100 | 503 | 320 |
| R3 | 15 | 890 | 335 | 0 | −45 | 90 | 289 | 48 | 460 | 130 | 494 | 325 |
| R4 | 15 | 890 | 335 | −20 | −45 | 90 | 289 | 48 | 460 | 130 | 494 | 320 |

HBA: hot band annealing of steel sheet
I = according to the invention;
R = reference;
underlined values: not according to the invention.

Table 3 gathers the results of test conducted in accordance of standards on different microscopes such as Scanning Electron Microscope for determining microstructural composition of both the inventive steel and reference trials.

TABLE 3 microstructures of the trials and the presence of Ferrite in Ferrite layer

| | Steel Sheet core | | | | | | | Ferrite |
|---|---|---|---|---|---|---|---|---|
| | | | | | Austenite | | | Layer Mean % |
| | | | Martensite | | | | total residual | ferrite from 0 to 50 μm |
| Trials | ferrite (%) | bainite (%) | partitioned (%) | fresh (%) | blocky (%) | film like (%) | austenite (%) | from the surface |
| I1 | 0 | 65 | 30 | 0 | 5 | 10 | 15 | 70 |
| I2 | 1 | 69 | 25 | 0 | 5 | 8 | 13 | 70 |
| I3 | 0 | 70 | 25 | 0 | 5 | 7 | 12 | 65 |
| I4 | 0 | 55 | 40 | 0 | 5 | 10 | 15 | 70 |
| I5 | 0 | 55 | 40 | 0 | 5 | 10 | 15 | 65 |
| R1 | 5 | 70 | 20 | 0 | 5 | 9 | 14 | 50 |

TABLE 3-continued

| microstructures of the trials and the presence of Ferrite in Ferrite layer | | | | | | | | |
|---|---|---|---|---|---|---|---|---|
| | Steel Sheet core | | | | | | | Ferrite |
| | | | | | Austenite | | | Layer Mean % |
| | | | Martensite | | | | total residual | ferrite from 0 to 50 μm |
| Trials | ferrite (%) | bainite (%) | partitioned (%) | fresh (%) | blocky (%) | film like (%) | austenite (%) | from the surface |
| R2 | 2 | 86 | 0 | 5 | 7 | 0 | 7 | 70 |
| R3 | 0 | 65 | 30 | 0 | 5 | 9 | 14 | 35 |
| R4 | 0 | 65 | 30 | 0 | 5 | 10 | 15 | 5 |

I = according to the invention;
R = reference;
underlined values: not according to the invention.

It can be seen from the table above that the trials according to the invention all meet the microstructure targets.

On the contrary, trial R1, which involves a composition out of the scope of the invention as it lacks the minimum value of molybdenum, shows a surface layer that is not sufficiently high in ferrite content, as molybdenum has a direct impact on the ferrite enrichment at the surface of the steel.

Trial R2, which involves a composition out of the scope of the invention as it lacks the minimum value of molybdenum was submitted to a CS1 temperature above Ms−5° C., which, in combination, triggered too much bainite formation. The ferrite layer is in target thanks to the optimal value of the dew point during heating.

Trials R3 and R4, where the required dew points control was not performed, show a ferrite surface layer that is clearly not sufficiently high in ferrite content.

Table 4 gathers the mechanical and surface properties of both the inventive steel and reference steel. The tensile strength yield strength and total elongation tests are conducted in accordance with ISO 6892-1 standards and the test for Hole expansion ratio is conducted accordance with ISO 16630 standards.

Table 4: mechanical and surface properties of the trials

The susceptibility of LME of the trials was evaluated by resistance spot welding method. To this end, for each Trial, one steel sheet corresponding respectively to trials I1 to I5 and to trials R1 to R4 was spot welded with two additional steel sheets to build a three-sheet stack-up including successively:

- one steel sheet corresponding to trials I1 to I5 and to trials R1 to R4,
- a sheet of 1.5 mm of an Interstitial free galvanized steel comprising 0.003% of carbon and 0.11% of manganese,
- a sheet of 1.5 mm of an Interstitial free galvanized steel comprising 0.003% of carbon and 0.11% of manganese.

Welding conditions were according to standard ISO-18278-2. The type of the welding electrode was F1 with a face diameter of 6 mm; the clamping force of the electrode was set at 450 daN. The welding cycle is as follows:

| Weld time | Current (Hz) | Welding time (ms) | Cool time (ms) |
|---|---|---|---|
| Cycle | 50 | 380 | 260 |

Each trial was reproduced 10 times to produce 10 spot welds at a current level defined as the upper welding limit of the current range from Imax to Imax+10%, max being comprised between 0.9 and 1.1*Iexp, Iexp being the intensity beyond which expulsion appears during welding, determined according to ISO standard 18278-2.

The cracks length in the 10 spot-welded joints was then evaluated after cross-sectioning through the surface crack and using an optical microscope. A grade was considered as providing enough LME resistance if less than 60% of the spots had a crack longer than 200 μm.

The yield strength YS, the tensile strength TS and the total elongation TE are measured according to ISO standard ISO 6892-1, published in October 2009. The hole expansion ratio is measured according to ISO standard 16630:2009.

| Trials | TS (MPa) | Total elongation (%) | Hole expansion ratio (%) | LME resistance | YS (MPa) |
|---|---|---|---|---|---|
| I1 | 1181 | 12.0 | 37 | OK | 846 |
| I2 | 1181 | 13.3 | 40 | OK | 852 |
| I3 | 1191 | 15.0 | 39 | OK | 868 |
| I4 | 1205 | 14.1 | 47 | OK | 965 |
| I5 | 1250 | 14.1 | 35 | OK | 969 |
| R1 | 1165 | 13.5 | 37 | NOT OK | 845 |
| R2 | 1218 | 11.5 | 25 | OK | 745 |
| R3 | 1243 | 13.9 | 45 | NOT OK | 981 |
| R4 | 1250 | 13.8 | 45 | NOT OK | 992 |

I = according to the invention;
R = reference;
underlined values: not according to the invention.

It can be seen from the table above that the trials according to the invention all meet the properties targets.

On the contrary, trial R1 shows a tensile strength value that is not enough, which is linked to the low content in molybdenum in the grade. Moreover, the LME resistance is not good, due to the low enrichment in ferrite in the surface layer, which is also linked to the low molybdenum content.

Trial R2 shows a TS value that is satisfactory, despite a low level in molybdenum. This is due to the content of niobium that can compensate for low molybdenum in terms of strength. However, the hole expansion ratio is below target notably because of an excessive amount of bainite and a too low amount of austenite.

Trials 3 and 4 do not show enough LME resistance, which is explained by the low ferrite amount in the surface layer.

The invention claimed is:

1. A cold-rolled and heat-treated steel sheet, the steel of the steel sheet having a composition comprising, in weight percentage:

0.17%≤carbon≤0.25%,
2%≤manganese≤3%,
0.9%≤silicon≤2%,
0%≤aluminum≤0.09%,
0.01%≤molybdenum≤0.2%,
0%≤phosphorus≤0.02%,
0%≤sulfur≤0.03%,
0%≤nitrogen≤0.09%,
and optionally one or more of the following elements:
0%≤chromium≤0.3%,
0%≤niobium≤0.06%,
0%≤titanium≤0.06%,
0%≤vanadium≤0.1%,
0%≤calcium≤0.005%,
0%≤boron≤0.010%,
0%≤magnesium≤0.05%,
0%≤zirconium≤0.05%,
0%≤cerium≤0.1%,
a balance including iron and unavoidable impurities, the steel sheet having a microstructure comprising 50% to 80% of bainite, 10% to 30% of residual austenite, 15% to 50% of partitioned martensite, 0% to 10% of ferrite and 0% to 5% fresh martensite in area fractions, and a ferrite-enriched layer extending up to 50 microns from both surfaces of the steel sheet, the ferrite-enriched layer having a mean ferrite content from 55% to 80% in area fraction.

2. The cold-rolled and heat-treated steel sheet as recited in claim 1, wherein the composition includes 2.2% to 2.9% of manganese.

3. The cold-rolled and heat-treated steel sheet as recited in claim 1, wherein the composition includes 0.18% to 0.23% of carbon.

4. The cold-rolled and heat-treated steel sheet as recited in claim 1, wherein the composition includes 1% to 1.9% of silicon.

5. The cold-rolled and heat-treated steel sheet as recited in claim 1, wherein the composition includes 0.05% to 0.15% of molybdenum.

6. The cold-rolled and heat-treated steel sheet as recited in claim 1, wherein the microstructure contains 55% to 75% of bainite.

7. The cold-rolled and heat-treated steel sheet as recited in claim 1, wherein the microstructure contains residual 12% to 25% of residual austenite.

8. The cold-rolled and heat-treated steel sheet as recited in claim 1, wherein the microstructure contains 15% to 45% of partitioned martensite.

9. The cold-rolled and heat-treated steel sheet as recited in claim 1, wherein the steel sheet has a tensile strength greater than or equal to 1170 MPa, and a hole expansion ratio of 30% or more.

10. The cold-rolled and heat-treated steel sheet as recited in claim 1, wherein the steels sheet has a yield strength greater than or equal to 780 MPa, and a total elongation of 12.0% or more.

11. The cold-rolled and heat-treated steel sheet as recited in claim 1, wherein the ferrite-enriched layer up to 50 microns from both surfaces contains 60% to 78% of ferrite in area fraction.

12. A method of manufacturing of a cold-rolled and heat-treated steel sheet comprising the following successive steps:

providing a semi-finished product with a steel composition comprising, in weight percentage:
0.1%≤carbon≤0.25%,
2%≤manganese≤3%,
0.9%≤silicon≤2%,
0%≤aluminum≤0.09%,
0.01%≤molybdenum≤0.2%,
0%≤phosphorus≤0.02%,
0%≤sulfur≤0.03%,
0%≤nitrogen≤0.09%,
and optionally one or more of the following elements:
0%≤chromium≤0.3%,
0%≤niobium≤0.06%,
0%≤titanium≤0.06%,
0%≤vanadium≤0.1%,
0%≤calcium≤0.005%,
0%≤boron≤0.010%,
0%≤magnesium≤0.05%,
0%≤zirconium≤0.05%,
0%≤cerium≤0.1%,
a balance including iron and unavoidable impurities, reheating the semi-finished product to a temperature from 1000° C. to 1280° C.;

rolling the semi-finished product completely in the austenitic range wherein the hot rolling finishing temperature is greater than or equal to 850° C. to obtain a hot rolled steel sheet;

cooling the hot rolled steel sheet at a cooling rate above 30° C./s to a temperature below or equal to 550° C.; and coiling the hot rolled steel sheet and keeping the temperature of coiled sheet below 500° C.;

cooling the hot rolled steel sheet;

cold rolling the hot rolled steel sheet with a reduction rate from 35 to 70% to obtain a cold rolled steel sheet;

annealing the cold rolled steel sheet in two steps heating during which the dew point is controlled from −15° C. to +15° C. and wherein:

the first step starts from heating the steel sheet from room temperature to a temperature HT1 from 600° C. to 800° C., with a heating rate HR1 from 2° C./s to 70° C./s, the second step starts from heating further the steel sheet from HT1 to a soaking temperature TA from Ac3-10° C. and Ac3+100° C., with a heating rate HR2 from 0.1° C./s and 10° C./s or less, HR2 being lower than HR1, then annealing at TA during 10 to 500 seconds, time being selected to obtain a minimum percentage of 90% austenite, the dew point being controlled from −10° C. to +10° C. during the annealing; then cooling the cold rolled steel sheet from TA to cooling stop temperature CS1 from Ms−5° C. to Ms−100° C. with a cooling rate CR1 greater than 30° C./s; then heating the cold rolled steel sheet from CS1 temperature to an overaging temperature TOA from 250° C. to 580° C. at an average heating rate HR3 from 1° C./s to 100° C./s; then overaging the cold rolled steel sheet at TOA during 5 to 500 seconds to obtain the cold-rolled and heat-treated steel sheet as recited in claim 1.

13. The method as recited in claim 12, wherein the HT1 temperature is from 625° C. to 775° C.

14. The method as recited in claim 12, further comprising coating the cold rolled steel sheet with zinc or a zinc-based alloy.

15. The method as recited in claim 12, further comprising performing a scale removal process on the hot rolled steel sheet.

16. The method as recited in claim 12, further comprising subjecting the hot rolled steel sheet to an annealing at a temperature from 350° C. to 750° C. for a duration of 1 h to 96 h.

17. The method as recited in claim 16, further comprising performing a scale removal process on the hot rolled annealed steel sheet.

18. A method comprising employing the cold rolled steel sheet produced according to the method of claim 12, for manufacture of a structural or safety part of a vehicle.

19. A method comprising employing the cold-rolled and heat-treated steel sheet as recited in claim 1, for manufacture of a structural or safety part of a vehicle.

* * * * *